United States Patent [19]

Givler

[11] 4,348,672

[45] Sep. 7, 1982

[54] INSULATED DRILL COLLAR GAP SUB ASSEMBLY FOR A TOROIDAL COUPLED TELEMETRY SYSTEM

[75] Inventor: Gregory C. Givler, Champaign, Ill.

[73] Assignee: Tele-Drill, Inc., Richardson, Tex.

[21] Appl. No.: 240,264

[22] Filed: Mar. 4, 1981

[51] Int. Cl.[3] ..... G01V 1/40

[52] U.S. Cl. ..... 340/854; 367/81; 175/40; 175/320

[58] Field of Search ..... 340/853, 854; 175/40, 175/50, 320; 166/66; 455/40, 41; 367/81, 82

[56] References Cited

U.S. PATENT DOCUMENTS

| | | | |
|---|---|---|---|
| 2,400,170 | 5/1946 | Silverman | 340/854 |
| 2,414,719 | 1/1947 | Cloud | 340/854 |
| 3,090,031 | 5/1963 | Lord | 340/854 |
| 3,274,798 | 9/1966 | Wiggins | 175/320 |
| 3,323,327 | 6/1967 | Leathers et al. | 175/320 |
| 3,926,265 | 12/1975 | Bouyoucos | 175/320 |
| 4,066,995 | 1/1978 | Matthews | 175/320 |

*Primary Examiner*—Howard A. Birmiel
*Attorney, Agent, or Firm*—John J. Byrne; Bradford E. Kile

[57] ABSTRACT

An insulated drill collar gap sub for a toroidal coupled telemetry system comprising a first annular sub member (100) operable to be connected at one end to a drill collar and a second annular sub member (104) operable to be connected at the other end to the drill collar. The first and second annular sub members have longitudinally extending interconnecting structural members (106, 118) operable to structurally interfere. The interconnecting structural members are dimensioned to form a continuous gap (116) between mutually opposing surfaces and a dielectric material (118) fills the gap to electrically isolate the first annular sub member (100) from the second annular sub member (108). A bearing member (124) is positioned between the first annular member and the second annular member but is insulated from at least one of said annular members to facilitate the formation of a drill collar of structural and electrical integrity.

9 Claims, 8 Drawing Figures

INSULATED DRILL COLLAR GAP SUB ASSEMBLY FOR A TOROIDAL COUPLED TELEMETRY SYSTEM

BACKGROUND OF THE INVENTION

This application relates to an apparatus for facilitating measuring bore hole data and for transmitting the data to the surface for inspection and analysis. Although the subject invention may find substantial utility at any stage in the life of a borehole, a primary application is in providing real time transmission of large quantities of data simultaneously while drilling. This concept is frequently referred to in the art as downhole measuring while drilling or simply measuring while drilling (MWD).

The incentives for downhole measurements during drilling operations are substantial. Downhole measurements while drilling will allow safer, more efficient, and more economic drilling of both exploration and production wells.

Continuous monitoring of downhole conditions will allow immediate response to potential well control problems. This will allow better mud programs and more accurate selection of casing seats, possibly eliminating the need for an intermediate casing string, or a liner. It also will eliminate costly drilling interruptions while circulating to look for hydrocarbon shows at drilling breaks, or while logs are run to try to predict abnormal pressure zones.

Drilling will be faster and cheaper as a result of real time measurement of parameters such as bit weight, torque, wear and bearing condition. The faster penetration rate, better trip planning, reduced equipment failures, delays for directional surveys, and elimination of a need to interrupt drilling for abnormal pressure detection, could lead to a 5 to 15% improvement in overall drilling rate.

In addition, downhole measurements while drilling may reduce costs for consumables, such as drilling fluids and bits, and may even help avoid setting pipe too early. Were MWD to allow elimination of a single string of casing, further savings could be achieved since smaller holes could be drilled to reach the objective horizon. Since the time for drilling a well could be substantially reduced, more wells per year could be drilled with available rigs. The savings described would be free capital for further exploration and development of energy resources.

Knowledge of subsurface formations will be improved. Downhole measurements while drilling will allow more accurate selection of zones for coring, and pertinent information on formations will be obtained while the formation is freshly penetrated and least affected by mud filtrate. Furthermore, decisions regarding completing and testing a well can be made sooner and more competently.

There are two principal functions to be performed by a continuous MWD system: (1) downhole measurements, and (2) data transmission.

The subject invention pertains to an element of the data transmission aspect of MWD. In the past several systems have been at least theorized to provide transmission of downhole data. These prior systems may be descriptively characterized as: (1) mud pressure pulse, (2) insulated conductor, (3) acoustic and (4) electromagnetic waves.

In a mud pressure pulse system the resistance to the flow of mud through a drill string is modulated by means of a valve and control mechanism mounted in a special drill collar sub near the bit.

The communication speed is fast since the pressure pulse travels up the mud column at or near the velocity of sound in the mud, or about 4,000 to 5,000 fps. However, the rate of transmission of measurements is relatively slow due to pulse spreading, modulation rate limitations, and other disruptive limitations such as the requirement of transmitting data in a fairly noisy environment.

Insulated conductors, or hard wire connection from the bit to the surface, is an alternative method for establishing down hole communications. The advantages of wire or cable systems are that: (1) capability of a high data rate; (2) power can be sent down hole; and (3) two way communication is possible. This type of system has at least two disadvantages; it requires a special drill pipe and it requires special tool joint connectors.

To overcome these disadvantages, a method of running an electrical connector and cable to mate with sensors in a drill collar sub was devised. The trade off or disadvantage of this arrangement is the need to withdraw the cable, then replace it each time a joint of drill pipe is added to the drill string. In this and similar systems the insulated conductor is prone to failure as a result of the abrasive conditions of the mud system and the wear caused by the rotation of the drill string. Also, cable techniques usually entail awkward handling problems, especially during adding or removing joints of drill pipe.

As previously indicated, transmission of acoustic or seismic signals through a drill pipe, mud column, or the earth offers another possibility for communication. In such systems an acoustic (or seismic) generator would be located near the bit. Power for this generator would have to be supplied downhole. The very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission. Moreover signal-to-noise limitations for each acoustic transmission path are not well defined.

The last major previously known technique comprises the transmission of electromagnetic waves through a drill pipe and the earth. In this connection electromagnetic pulses carrying downhole data are input to a toroid positioned adjacent a drill bit. A primary winding, carrying the data for transmission, is wrapped around the toroid and a secondary is formed by the drill pipe. A receiver is connected to the ground at the surface and the electromagnetic data is picked up and recorded at the surface.

In conventional drillstring toroid designs a problem is encountered in that an outer sheath which must protect the toroid windings must also provide structural integrity for the toroid. Since the toroid is located in the drill collar, large mechanical stresses will be imposed on it. These stresses include tension, compression, torsion and column bend. This structural problem is exacerbated when it is realized that the conductive drill collar is attached at both ends to the outer sheath of the toroid. Such structure will thus provide, a path for a short circuited turn. Accordingly it is essential to provide an insulation gap in the drill collar notwithstanding severe environmental loading.

The problems and unachieved desires set forth in the foregoing are not intended to be exhaustive but rather are representative of the severe difficulties in the art of transmitting borehole data. Other problems may also exist but those presented above should be sufficient to demonstrate that room for significant improvement remains in the art of transmitting borehole data.

In the above connection, notwithstanding substantial economic incentives, and significant activity and theories by numerous interests in the industry, applicants are not aware of the existence of any commercially available system for telemetering while drilling substantial quantities of real time data from a borehole to the surface.

OBJECTS OF THE INVENTION

It is therefore a general object of the invention to provide a novel apparatus for use in a system to advantageously telemeter large quantities of real time data from a borehole to the surface.

It is a particular object of the invention to provide a toroidal coupled, data transmission system wherein the normal functioning of a conventional drill collar is not disturbed.

It is a related object of the invention to provide a novel toroidal coupled, data transmission system wherein the drill collar is provided with an electrical isolation sub to prevent short circuiting the secondary of the data transmission system.

It is a further object of the invention to provide a novel electrical isolation sub and structural assembly for a MWD drill collar which is highly rugged and practical for sustained downhole operation while concomitantly providing a toroidal coupled real time data transmission system.

BRIEF SUMMARY OF THE INVENTION

A preferred form of the invention which is intended to accomplish at least some of the foregoing objects comprises a first annular sub member operable to be connected at one end to a drill collar and a second annular sub member operable be connected at the other end to the drill collar. The first and second annular sub members have longitudinally extending interconnecting structural members operable to structurally interfere. The interconnecting structural members are dimensioned to form a continuous gap between mutually opposing surfaces and a dielectric material fills the gap to electrically isolate the first annular sub member from the second annular sub member.

THE DRAWINGS

Other objects and advantages of the present invention will become apparent from the following detailed description of preferred embodiments thereof taken in conjunction with the accompanying drawings, wherein.

DETAILED DESCRIPTION

Figure 1:
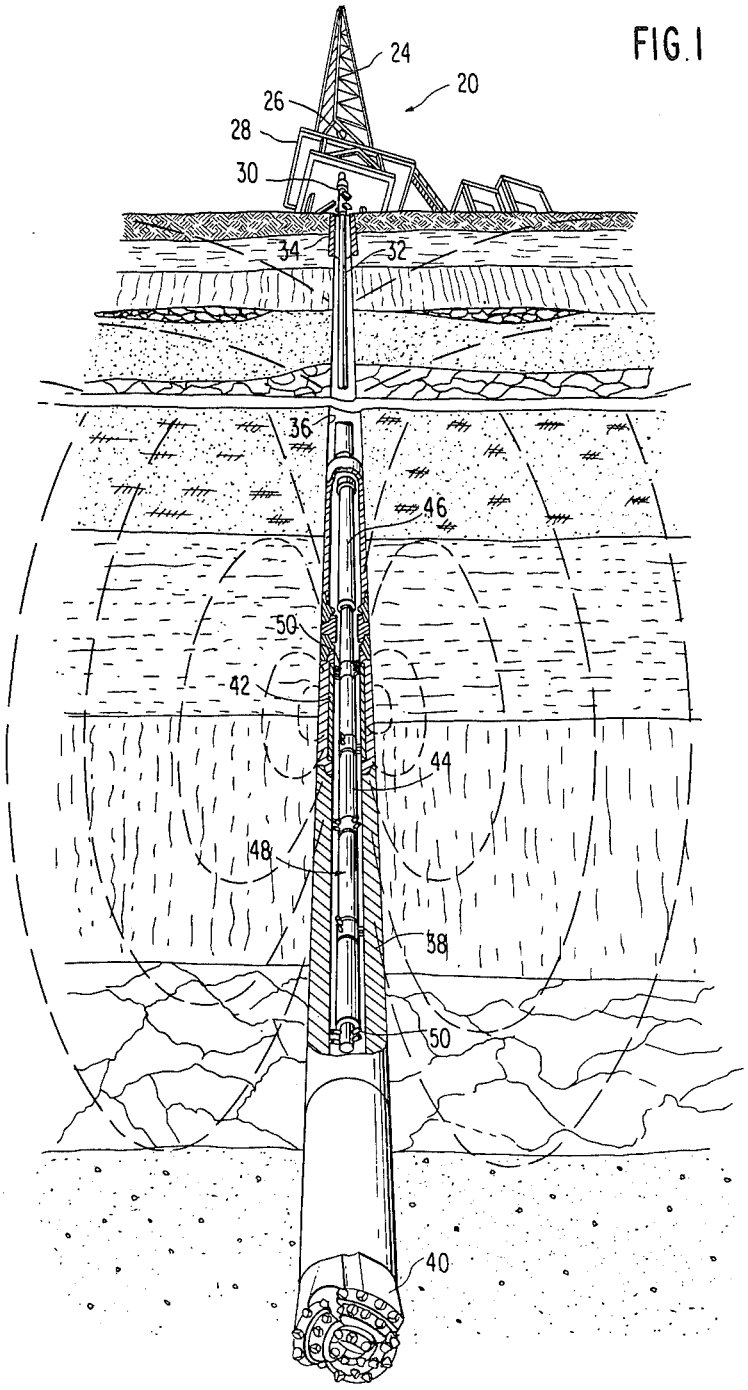
FIG. 1 is a perspective view from the downhole end of a drill string disclosing a drill collar and a toroidal coupled MWD system for continuously telemetering real time data to the surface.

Referring now to the drawings, wherein like numerals indicate like parts, there will be seen various views of a toroidal coupled, MWD telemetry system in which the subject invention has particular application and detail views of preferred embodiments of insulated drill collar gap sub assemblies in accordance with the subject invention.

Context of the Invention

Before providing a detailed description of the subject structural assemblies it may be worthwhile to outline the context of the instant invention. In this connection and with reference to FIG. 1 there will be seen a conventional rotary rig 20 operable to drill a borehole through variant earth strata. The rotary rig 20 includes a mast 24 of the type operable to support a traveling block 26 and various hoisting equipment. The mast is supported upon a substructure 28 which straddles annular and ram blowout preventors 30. Drill pipe 32 is lowered from the rig through surface casing 34 and into a borehole 36. The drill pipe 32 extends through the bore hole to a drill collar 38 which is fitted at its distal end with a conventional drill bit 40. The drill bit 40 is rotated by the drill string, or a submerged motor, and penetrates through the various earth strata.

The drill collar 38 is designed to provide weight on the drill bit 40 to facilitate penetration. Accordingly such drill collars typically are composed with thick side walls and are subject to severe tension, compression, torsion, column bending, shock and jar loads. In the subject system, the drill collar further serves to enhouse a data transmit toroid 42 comprising a winding core for a downhole data telemetering system. Finally the subject drill collar 38 also functions as a support to hang a concentrically suspended telemetering tool 44 operable to detect and transmit downhole data to the surface concomitantly with normal operation of the drilling equipment.

The telemetering tool 44 is composed of a number of sections in series. More specifically a battery pack 46 is followed by a sensing and data electronics transmission section 48 which is concentrically maintained and electrically isolated from the interior of the drill collar 38 by a plurality of radially extending fingers 50 composed of a resilient dielectric material.

Figure 2:
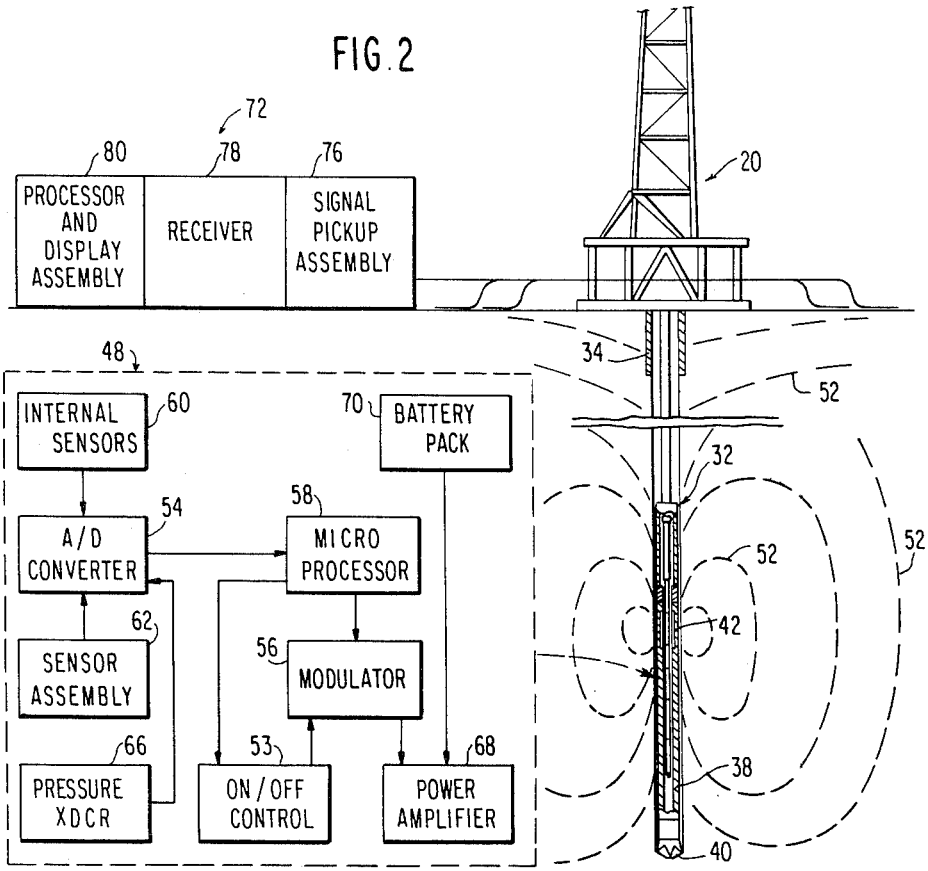
FIG. 2 is a schematic view of the MWD telemetering system disclosed in FIG. 1 including a block diagram of a downhole electronic package which is structurally internal to the drill collar and an uphole signal pickup system.
Figure 3:
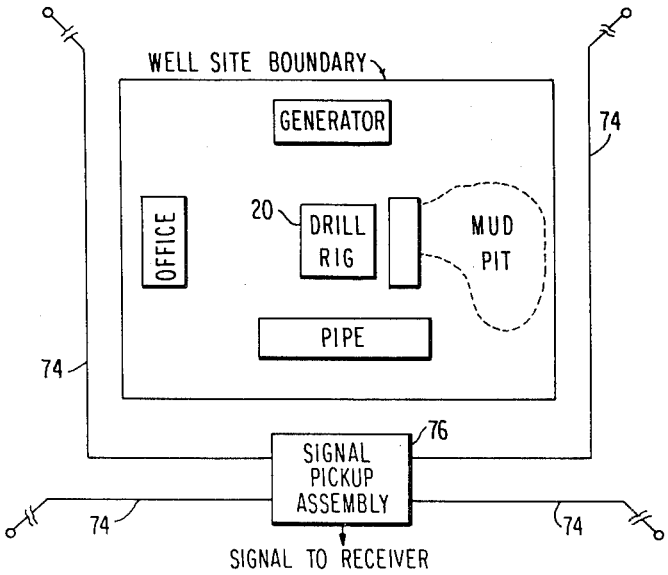
FIG. 3 is a plan view of the uphole system for picking up MWD data signals.

Turning now to FIGS. 2 and 3, there will be seen system diagrams for a toroidal-coupled MWD telemetry system. In this system drill bit, environmental and/or formation data is supplied to the tool data electronics sections 48. This section includes an on/off control 52, an A/D converter 54, a modulator 56 and a microprocessor 58. A variety of sensors 60, 62 etc. located throughout the drill string supply data to the electronics section 48.

Upon receipt of a pressure pulse command 66, or expiration of a time-out unit, whichever is selected, the electronics unit will power up, obtain the latest data from the sensors, and begin transmitting the data to a power amplifier 68.

The electronics unit and power amplifier are powered from nickel cadmium batteries 70 which are configured to provide proper operating voltage and current.

Operational data from the electronics unit is sent to the power amplifier 68 which establishes the frequency, power and phase output of the data. The data is then shifted into the power amplifier 68. The amplifier output is coupled to the data transmit toroid 42 which electrically approximates a large transformer wherein the drill string 32 is a part of the secondary.

The signals launched from the toroid 42 are in the form of electromagnetic wave fronts 52 traveling through the earth. These waves eventually penetrate the earth's surface and are picked up by an uphole system 72.

The uphole system 72 comprises radially extending receiving arms 74 of electrical conductors. These conductors are laid directly upon the ground surface and may extend for three to four hundred feet away from the drill site. Although the generally radial receiving arms 74 are located around the drilling platform, as seen in FIG. 3, they are not in electrical contact with the platform or drill rig 20.

The radial receiving arms 74 intercept the electromagnetic wave fronts 52 and feed the corresponding signals to a signal pickup assembly 76 which filters and cancels extraneous noise which has been picked up, amplifies the corresponding signals and sends them to a low level receiver 78.

A processor and display system 80 receives the raw data output from the receiver, performs any necessary calculations and error corrections and displays the data in a usable format.

Figure 4:
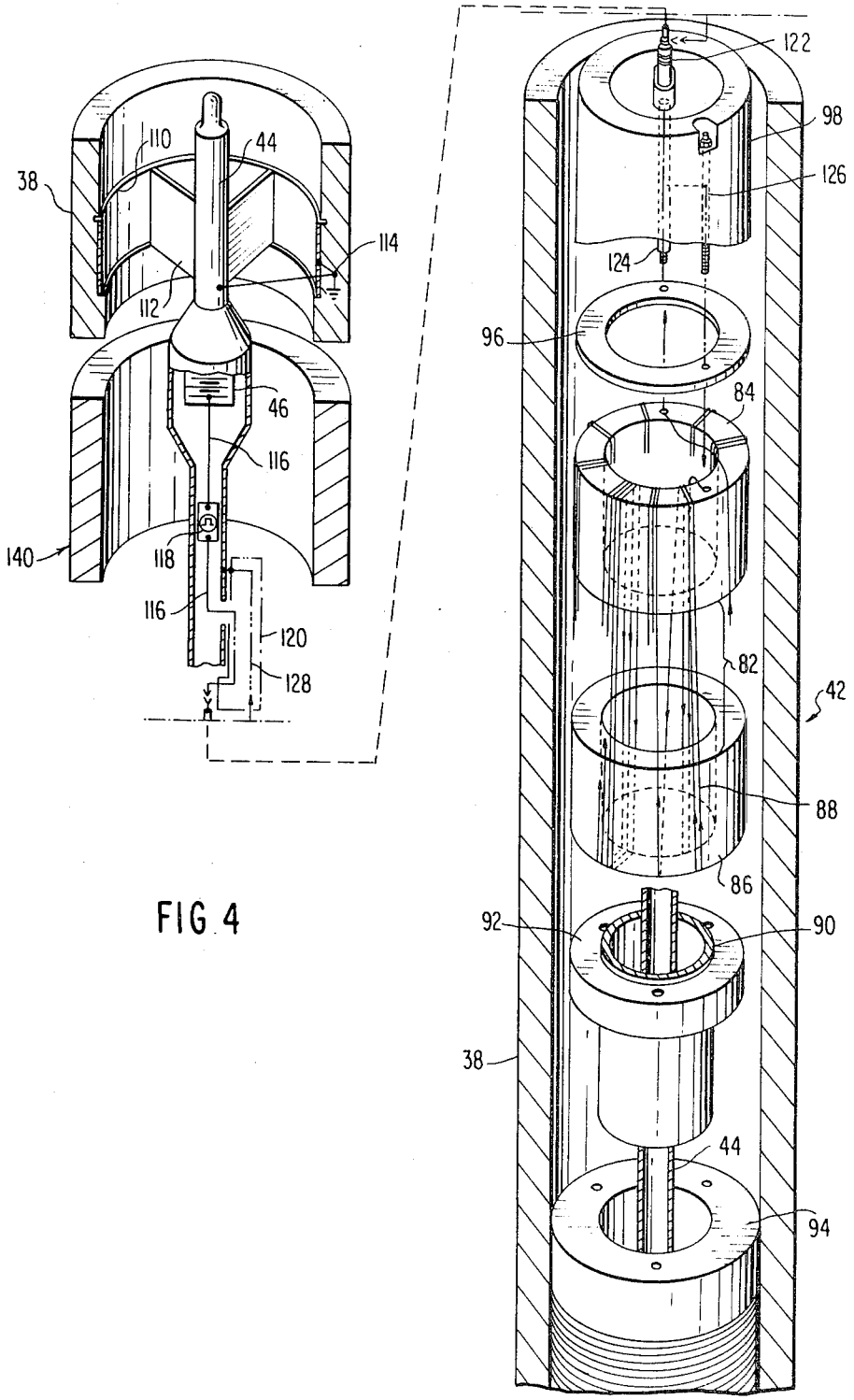
FIG. 4 is an exploded, schematic view of a toroid unit for use in the subject MWD system including a schematic representation of an insulated gap sub assembly in accordance with the subject invention.

Referring now to FIG. 4 there will be seen a broken away, partial detail partial schematic view of the previously noted data transmit toroid 42. In this view the toroid is composed of a plurality of cylindrical members (not shown) which are positioned in area 82. An upper termination block 84 and lower termination block 86 illustrates the configuration of the intermediate toroids. The cylindrical toroid cores are composed of a ferromagnetic material such as silicon steel, permalloy, etc. The termination blocks are composed of aluminum with an insulation coating and serve to hold the intermediate toroid cores in position and provide end members to receive a primary toroid winding 88.

The toroid package is mounted about a mandrel 90 which extends up through the toroid collars. In FIG. 4, however, the mandrel is broken away to better illustrate the primary winding 88 of the toroid. The mandrel 90 has a radially extending flange 92 which rests upon and is bolted to a bottom sub 94 connected to the drill collar. A similar support arrangement, not shown is provided above an insulated space ring 96 and an electrical connector block assembly 98 to fixedly secure and joint the toroid section 42 to the drill collar 38. In substance thereby the toroid becomes a part of the drill collar and drilling mud flows in an uninterrupted path through the center of mandrel 90 to permit a continuous drilling operation.

As previously indicated a telemetering tool 44 is designed to be positioned within the drill collar 38 and hangs from the drill collar by a landing connector 110 having radial arms 112 connected to an upper portion of the tool 44.

The battery pack 46 is schematically shown encased within an upper segment of tool 44. A negative of the battery pack is connected to the tool 44 which is in direct electrical communication to the drill collar 38 and drill pipe 34, note the schematic representation at 114. The positive terminal of the battery pack 46 extends along line 116 to a data source schematically depicted at 118. The data to be transmitted is input to the toroid system at this point.

The line 116 then feeds into an electrical connector guide, schematically shown at 120. The guide may be a spider support arrangement which the tool slides into to establish an electrical couple between line 116 and electrical connector 122. The line then passes through a cylindrical insulation sleeve 124 and connects directly to the primary 88 of the toroid assembly 42. The other end of the toroid primary extends through the electrical connector block housing 98 at 126 and connects to an outer sheath of the electrical connector 122 which is in communication with the too outer sheath through line 128 and thus back to ground in the drill collar at 114.

The secondary of the toroid transmit system is composed of the drill collar 38 and drill string 32. In order to prevent a short turn through the drill collar it is necessary to provide an insulated zone 140 in the drill collar. As previously indicated, however, the drill collar must also be structurally rugged and capable of withstanding tremendous down-hole forces of tension, compression, torque, column bend, vibration and jarring on a sustained basis, in order to provide a normal drilling function.

Insulated Gap Assembly

The subject invention is directed to novel insulated gap sub assemblies which are capable of providing electrical isolation to permit operation of continuous MWD, toroidal coupled, telemetering while maintaining structural integrity of a drill collar.

Figure 5:
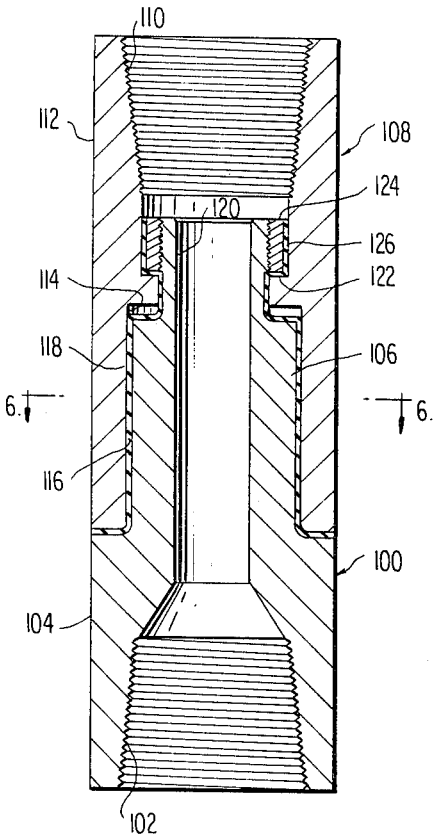
FIG. 5 is a side view of an insulated gap sub assembly in accordance with one preferred embodiment of the invention.
Figure 6:
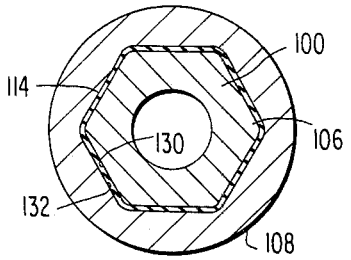
FIG. 6 is a cross-sectional view taken along line 6—6 in FIG. 5.

Referring now to FIGS. 5 and 6 there will be seen an insulated drill collar gap sub in accordance with one preferred embodiment of the invention. In this connection a first annular sub member 100 is provided having conventional screw threads 102 fashioned at one end thereof for direct connection to a drill collar. The first annular sub member 100 includes a base portion 104, at one end thereof, and axial extension 106, at the other end thereof. The cross-sectional dimension of the axial extension is less than the cross-sectional dimension of the base portion as illustrated in FIG. 5.

The insulated drill collar gap sub further includes a second annular sub member 108 having a threaded portion 110, at one end thereof, which is operable to be connected directly to a drill collar. The second annular sub member 108 is further formed with a base 112 and an axially extending recess 114 at the other end thereof.

The cross-sectional dimension of the axially extending recess 114 is dimensioned to be compatible with but greater than cross-sectional dimension of the axial extension 106 of the first annular sub member 100. Accordingly a generally uniform peripheral gap 116 is formed between the axial extension and the axially extending recess. This gap is filled with a dielectric material such a resin composition which is selected for its dielectric properties while simultaneously providing substantial load bearing capability.

In order to couple the first and second annular sub members a further axial extension 120 is fashioned at the distal end of extension 106 and is provided with an outer thread. The second annular sub member is fashioned with an inner flange 122. A retainer ring 124 is releasably threaded onto the further extension 120 and operably abutts against the flange 122. In order to maintain the electrical isolation between the first and second annular sub assemblies a dielectric collar 126 is positioned about the retaining ring 124 between said ring and the flange and sidewalls of said annular sub member 108 has depicted in FIG. 5.

In order to prevent relative axial rotation of the first annular sub member 100 with respect to the second annular sub member 108 a longitudinally extending innerface is provided between the axial extension 106 and the axially extending recess 114. In the embodiment of FIGS. 5 and 6 this interconnecting structure comprises a longitudinally extending planar surface 130 on the axial extension member 106 and a compatibly dimensioned longitudinally extending planar surface 132 fashioned within the axially extending recess 114. A plurality of such planar surfaces may in fact be formed and the subject invention envisions such formation will comprise a polygonal configuration in cross-section. Moreover in a preferred embodiment that polygonal cross-section will comprise a regular hexagon as depicted in FIG. 6. Such cooperation of planar surfaces will effectively prevent axial rotation of the first annular sub member 100 with respect to the second annular sub member 108.

Figure 7:
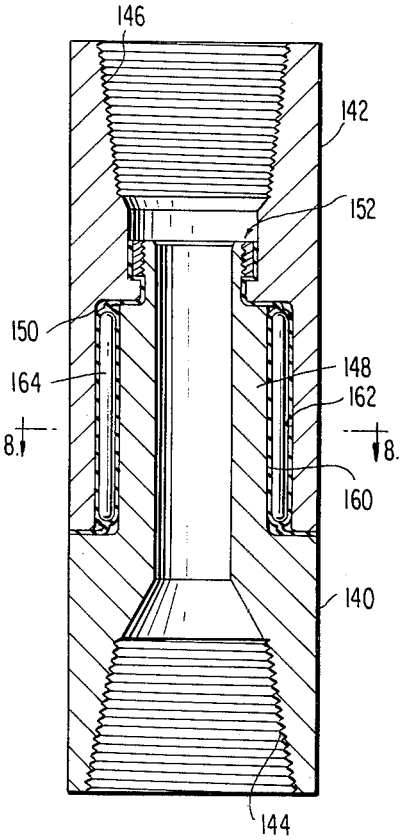
FIG. 7 is a sectional side view of an insulated gap sub assembly in accordance with a second preferred embodiment of the invention.
Figure 8:
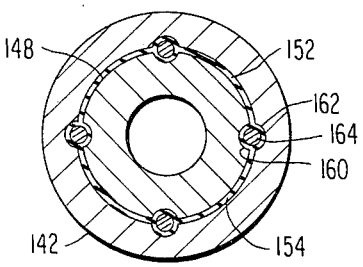
FIG. 8 is a cross-sectional view taken along section line 8—8 in FIG. 7.

Turning now to FIGS. 7 and 8 there will be seen an alternate preferred embodiment of the invention. In this embodiment a first annular sub member 140 and a second annular sub member 142 are provided with screw threads 144 and 146 respectively for direct connection to a drill collar.

The first annular sub member 104 is fashioned with an axial extension 148 which is operable to be received within an axially extending recess 150 formed within the second annular sub member 142. The axially extending member 148 and the axially extending recess 150 are dimensioned to be contiguous to but mutually spaced such that a generally uniform gap 152 is formed between the opposing surfaces thereof. This gap is operable to receive a dielectric material 154. The dielectric material effectively provides an electrical isolation between the first and second annular sub members 140 and 142.

The first and second annular sub members are axially locked together by an axial bearing assembly 152 which is identical in structure and function with a corresponding assembly discussed with respect to the embodiment of the invention disclosed in FIGS. 5 and 6. Accordingly that detailed description is hereby repeated by reference as though set by at length.

Relative axial rotation of the first annular sub member 140 is prevented with respect to the second annular sub member 142 by the provision of longitudinally extending elements. More specifically at least one longitudinally extending recess 160 is fashioned within the axial extension 148 and a similar longitudinally extending recess 162 is fashioned within the axially extending recess 150. These two recesses are effectively locked against relative rotation by the placement of a longitudinally extending pin 164 comprised of a solid cylindrical rod. In a preferred embodiment as specifically disclosed in FIG. 8 four semi-circular longitudinally extending recesses are formed in both of the axial extension 148 and the axially extending recess 150.

In a preferred embodiment it is presently envisioned that high strength metals will be utilized for the structural members such as various steel alloys. It is possible that in some instances, however, other materials will be suitable to provide the strength required of an element in a drill collar such as: fiber composites, thermosetting plastics, resin injected wood, etc.

SUMMARY OF MAJOR ADVANTAGES OF THE INVENTION

After reviewing the foregoing description of preferred embodiments of the invention, in conjunction with the drawings, it will be appreciated by those skilled in the art that several distinct advantages are obtained by the subject invention.

Without attempting to detail all of the desirable features specifically and inherently set forth above, a major advantage of the invention is the providsion of an insulated drill collar gap sub assembly for a toroidal coupled telemetry system wherein normal functioning of the drill collar is maintained. At the same time transmission of large quantities of real time data to the surface is achieved by electromagnetically coupling a primary toroid winding carrying the data to the surface utilizing the drill string and drill collar as a secondary.

The subject insulated gap sub assemblies permit the foregoing data transmission because of the electrical isolation provided thereby and thus elimination or minimizing the possibility of providing a secondary short turn within the system.

The subject drill gap sub embodiments each disclose singularly rugged inner connecting structures which are mutually contiguous but spaced from one another to provide a generally uniform annular gap which is filled with a dielectric material. The interconnecting structures of the subject invention carry the mechanical loads of the collar by distributing such loads throughout the interconnecting structure thus minimizing potential to rupture the dielectric material within the annular gaps. In each case axial bearing members are provided to facilitate the transmission of force through the gap sub assembly and further protect the dielectric material from extrusion.

The subject insulated drill collar gap sub assembly further provides longitudinally extending inter-locking elements which effectively prevent relative axial rotation between the first annular sub member and the second annular sub member so as to further heighten the structural integrity of the insulated gap sub.

In describing the invention, reference has been made to preferred embodiments. Those skilled in the art, however, and familiar with the disclosure of the subject invention, may recognize additions, deletions, modifications, substitutions and/or other changes which will fall within the purview of the subject invention as defined in the claims.

I claim:

1. An insulated drill collar and gap for a toroidal coupled telemetry system comprising:

a first annular sub member operable to be connected at one end to a drill collar and form a part of the drill collar, said first annular sub member having a base portion at said one end thereof, and an axial extension at the other end thereof, having a cross-sectional dimension less than the cross-sectional dimension of said base portion;

a second annular sub member operable to be connected at one end to a drill collar, and form a part of the drill collar, said second annular sub member having a base portion at said one end thereof, and an axially extending recess at the other end thereof, and having a cross-sectional dimension compatible with but greater than the cross-sectional dimension of said axial extension to form a peripheral gap between said axial extension and said axially extending recess;

dielectric material positioned within and occupying said gap between said axial extension and said axially extending recess to form an electrical isolation between said axial extension and said axially extending recess;

axial bearing means connecting said first annular sub member to said second annular sub member;

dielectric means positioned between said first and second annular sub members at said axial bearing means to electrically isolate said first and second annular sub members at said bearing location; and longitudinally extending means for preventing relative rotation between said first annular sub member and said second annular sub member wherein a connection between said first annular sub member and said second annular sub member is formed of structural integrity and concomitant electrical isolation.

2. An insulated drill collar gap sub for a toroidal coupled telemetry system as defined in claim 1 wherein said longitudinally extending means comprises:

at least one longitudinally extending planar surface on said axial extension of said first annular sub member; and at least one longitudinally extending planar surface on the interior of said recess of said second annular member which is compatibly dimensioned to longitudinally interengage with said planar surface on said axial extension to prevent relative rotation of said first annular sub member with respect to said second annular sub member.

3. An insulated drill collar gap sub for a toroidal coupled telemetry system as defined in claim 2 wherein:

said axial extension member comprises a polygon in cross-section; and said axially extending recess of said second annular sub member being compatibly dimensioned in cross-section with said axial extension member.

4. An insulated drill collar gap sub for a toroidal coupled telemetry system as defined in claim 3 wherein:

said axial extension member and said axially extending recess are configured to form a regular hexagon in cross-section.

5. An insulated drill collar gap sub for a toroidal coupled telemetry system as defined in claim 1 wherein said longitudinally extending means comprises:

at least one longitudinally extending recess in one of said axial extensions of said first annular sub member and said axially extending recess of said second annular sub member; and at least one means cooperating with the other of said axial extension of said first annular sub member and said axially extending recess of said second annular sub member and extending into said at least one longitudinally extending recess to prevent relative rotation between said first and second annular sub members.

6. An insulated drill collar gap sub for a toroidal coupled telemetry system as defined in claim 5 wherein said at least one means cooperating with the other of said axial extension of said first annular sub member and said axially extending recess of said second annular sub member comprises:

at least one longitudinally extending recess in the other of said axial extension of said first annular sub member and said axially extending recess of said annular sub member; and at least one longitudinally extending pin means cooperating with said at least one longitudinally extending recess in the other of said axial extension of said first annular sub member and said axially extending recess of said second annular sub member.

7. An insulated drill collar gap sub for a toroidal coupled telemetry system defined in claim 6 wherein:

said longitudinal recesses in both of said one and the other of said axial extension of said first annular sub member and said axially extending recess of said second annular sub member being semi-circular in cross-section; and said at least one longitudinally extending pin comprising a solid cylindrical rod.

8. An insulated drill collar gap sub for a toroidal coupled telemetry system as defined in claim 7 wherein:

four semi-circular longitudinally extending recesses are formed in both of said one and the other of said axial extension of said first annular sub member and said axially extending recess of said second annular sub member; and a longitudinally extending pin is positioned within each of opposing pairs of said semi-circular longitudinally extending recesses.

9. An insulated drill collar gap sub for a toroidal coupled telemetry system as defined in claim 1 wherein said axial bearing means comprises:

a further axial extension projecting outwardly from the axial extension of said first annular sub member;

an annular flange fashioned upon an interior surface of said second annular sub member; and a retainer ring releasably connected to the outermost end of said further axial extension and axially bearing through said dieletric means at said axial bearing means against said annular flange.

* * * * *